United States Patent [19]

Tamada et al.

[11] 4,037,082

[45] July 19, 1977

[54] POSITIVE TEMPERATURE COEFFICIENT SEMICONDUCTOR HEATING DEVICE

[75] Inventors: Minoru Tamada; Takashi Shikama; Toshikazu Nakamura, all of Yokaichi, Japan

[73] Assignee: Murata Manufacturing Co., Ltd., Nagaokakyo, Japan

[21] Appl. No.: 682,041

[22] Filed: Apr. 30, 1976

[51] Int. Cl.[2] ..... H05B 3/10

[52] U.S. Cl. ..... 219/541; 219/353; 219/505; 219/540; 219/544; 219/553; 338/22 R

[58] Field of Search ..... 219/353, 504, 505, 530, 219/540, 541, 544, 552, 553; 338/22 R, 22 SD, 322

[56] References Cited

U.S. PATENT DOCUMENTS

| | | | |
|---|---|---|---|
| 2,804,581 | 8/1957 | Lightgarn | 338/22 S DX |
| 3,452,314 | 6/1969 | Sapoff et al. | 338/22 R |
| 3,748,439 | 7/1973 | Ting et al. | 219/353 |
| 3,835,434 | 9/1974 | Kahn | 338/22 R |
| 3,885,129 | 5/1975 | Fabricius | 219/553 |
| 3,940,591 | 2/1976 | Ting | 219/505 X |
| 3,976,854 | 8/1976 | Ishikawa et al. | 219/505 |

*Primary Examiner*—Volodymyr Y. Mayewsky
*Attorney, Agent, or Firm*—Birch, Stewart, Kolasch & Birch

[57] ABSTRACT

An arrangement of components for constructing a heating device employing positive temperature coefficient semiconductor (PTCS) heating elements comprising the PTCS heating element, upper and lower insulating plates, a heat emission plate and a case for entirely covering the layers of the PTCS heating element and the upper and lower insulating plates.

6 Claims, 19 Drawing Figures

POSITIVE TEMPERATURE COEFFICIENT SEMICONDUCTOR HEATING DEVICE

The present invention relates to a heating device, and more particularly to a structure for a heating device utilizing a positive temperature coefficient semiconductors (PTCS).

This application is related to copending U.S. patent application of Ser. No. 682,161, filed on Apr. 30, 1976, and entitled "Positive Temperature Coefficient Semiconductor Heating Element," applied by the same applicant.

Numerous types of heating devices have been developed in the prior art, which utilize some form of PTCS heating elements. There is shown, in FIGS. 1 and 2, a typical PTCS heating device A of a conventional type having electrodes *b* and *c* entirely formed on parellel opposed flat surfaces of a PTCS body *d*, such as a thermistor. Here, the unit of heating body *d* formed with electrodes *b* and *c* is generally called a PTCS heating element. The PTCS heating device A is further formed with a heat transmitting plate *e* and a heat emitting plate *f* which are sequentially bonded on one of the electrodes in that order. Free surface *f'* of the heat emitting plate *f* is attached to an object (not shown) to be heated. When a suitable voltage is applied between the electrodes *b* and *c*, the PTCS body *d* generates thermal energy which is transmitted to the heat emitting plate *f* through the heat transmitting plate *e* and also to the open-air from the surface having the electrode *b*. Such a conventional heating device may be equipped with a simple covering (not shown) for isolation from the external atmosphere or in many cases no cover at all, thus much of the heat produced in the PTCS body was lost in the open-air. Also, the PTCS body or element may come off from the remainder of the device by an impact or a shock imparted to the device, since they are merely bonded on the plate and the heat may weaken the sticking strength.

In addition to above described undersirable facts, the conventional heating device of the above described type has such a disadvantage as described below.

Referring to FIGS. 1 and 2, with the voltage applied to the PTCS body *d* in its thickness direction, heat is generated almost evenly in the PTCS body *d*. Therefore, heat can be considered to be produced from heat generating point *x*, which is located at the center of the PTCS body *d*. The heat transmitted from the point *x* onto the heat emitting plate (point *y*), however, is not totally equal to the heat generated in the PTCS body *d*, but some percentage thereof is lost in the heat transmitting plate *e*, and also in the PTCS body *d*. Such heat loss is caused by a heat resistance R which can be given by the following equation.

$$R = a \cdot (D/K \cdot S) \qquad (1)$$

wherein *a* is constant, *D* is distance between the heat generating point and heat emitting surface, *K* is heat conductivity, and *S* is heat emission effective area.

When applying the above equation in the conventional heating device *A*, the heat resistance *R* thereof can be given by the following equation.

$$R = a \cdot (D1 + D2)/(K \cdot S) \qquad (2)$$

wherein D1 is a distance between the point *x* and the electrode *c* and D2 is a thickness of the heat transmitting plate *e*.

It is clear that a heating device with a small degree of resistance *R* is more efficient in heat transmission towards the object.

Considering the equation (2), the heat resistance *R* can be made small with respect to the decrease of the *D1* + *D2*, or the increase of the heat emission effective area *S*. From the aspect of decreasing the heat resistance *R*, there have been proposed various improvements in the PTCS heating element. For example, broadening the heat emission effective area *S* by enlarging the PTCS body *d* or reducing the thickness of the PTCS body *d* to bring the point *x* close to the surface where the electrode *c* exists. Such improvements, however, have resulted in a large size heating device due to the enlargement of the PTCS body *d*, or otherwise the dielectric characteristics of the PTCS body *d* have been diminished to such a degree that the PTCS body *d* is not able to tolerate the high voltage in the useable range.

Another conventional type of PTCS heating element has a pair of opposite electrodes disposed on one of the opposed surfaces of the PTCS body and separated from each other by a predetermined distance. Although, this type of PTCS heating element has a heat generating point *x* close to said surface of the PTCS body, the heat generating point *x* is not exactly on the surface. Because a pair of terminals for connecting the power source provided on the other surface allows the current to flow in the thickness direction, some heat is generated in the inside of the PTCS body *d*. More specifically, since the terminals holding part of the PTCS body therebetween are normally comparatively large in area for easy and ensured connection with the lead wire or extendng terminal piece, considerable heat is undesirably generated in a direction of thickness especially at the point of the PTCS body held between the terminals, which heat should be distributed over the entire surface of said PTCS body for achieving efficient heat radiation therefrom.

Accordingly, a primary object of the present invention is to provide an improved type of a PTCS heating device which efficiently produces heat from a heat emission plate.

Another object of the present invention is to employ in the PTCS heating device, a PTCS heating element which generates heat effectively from at least one of the opposite flat surfaces, i.e., heat generating point *x* exists at least on one of the opposite surfaces of the PTCS body.

Still another object of the present invention is to provide an improved type of a PTCS heating device of the above described type in which heat generated by the PTCS heating element is efficiently conducted to the heat emission plate and distribution of the heat emission from the heat emission plate is approximately even at every point thereof.

A further object of the present invention is to provide an improved type of a PTCS heating device of the above described type in which the PTCS body incorporated therein is not easily disengaged by a shock or an impact.

Still further object of the present invention is to provide an improved type of a PTCS heating device of the above described type which is simple in construction, and can readily be manufactured.

The PTCS heating device of the present invention comprises a PTCS heating element surrounded by an electrically isolating material having good heat conductivity, a heat emission plate receiving thereon said PTCS heating element and a case means completely enclosing therein said PTCS heating element together with the heat emission plate. Such PTCS heating element comprises:

a. a PTCS body having two opposite flat and mutually parallel faces;

b. a first electrode having a plurality of strips of metal film electrically connected to each other at its one end and being separated from each other along their respective length with at least one of said strips being shorter than other strips and said first electrode being provided on an upper face of said two faces of said PTCS body;

c. a second electrode having a plurality of strips of metal film electrically connected to each other at its one end and being separated from each other along their respective length with at least one of said strips being shorter than other strips and said second electrode being provided on said upper face in such a manner that the strips of opposite electrodes are alternately disposed on said upper face so that neighboring strips of respective strips are members of opposite electrode;

d. a first terminal of a pair of terminals for applying predetermined voltage, said first terminal being electrically connected to said first electrode and provided on a bottom face of said two faces at such a position that said first terminal does not overlap, through the PTCS body, with any of the strips of said second electrode; and e. a second terminal of said pair of terminals, said second terminal electrically connected to said second electrode and provided on said bottom face at such a position that said second terminal does not overlap, through the PTCS body, with any of the strips of said first electrode.

More specifically, the above described PTCS heating element includes a PTCS body having two opposed flate surfaces and two sets of alternately disposed electrodes each provided on one of the flat surfaces. Each electrode has the plurality of strips having a finger or fork-like shape, in which, each strip is disposed in such a manner that the neighboring electrodes are members of opposite sets of electrodes. Each electrode is further provided with a sheet of metal film which serves as an electrical terminal, disposed on the other flat surface of the PTCS body in such a manner that the finger-like strips of opposite electrodes do not overlap, through the PTCS body, with the sheet of metal film. When the PTCS heating element is charged with a suitable voltage, the electrical current in the PTCS body tends to flow mainly near the body surface between neighboring electrodes, thus only a thin outer region of the PTCS body between the two opposite electrodes acts as the thermal energy generating region, thereby enabling quick response of heat emission to take place in relation to the electrical currents. Accordingly, the heat generating point $x$ can be considered to be existing on said surface having the two sets of electrodes. It should be noted that said surface is facing the heat emission plate.

The PTCS heating device of the present invention further comprises a pair of L-shaped terminal units each of which is seated on the terminal of the PTCS element and extending outwardly from the PTCS heating device through an opening formed in the case means.

When a suitable voltage is applied between the terminal units, the heat generated in the PTCS body is transmitted mostly towards the heat emission plate through the electrical isolating material, and part of heat is transmitted towards the case means. Since the case means and the heat emission plate are connected tightly by a rim or frame of the case means, the heat transmitted to the case means can be easily conducted to the heat emission plate and to the object to be heated.

These and other objects and features of the present invention will become apparent from the following description taken in conjunction with a preferred embodiment thereof with reference to the accompanying drawings, wherein:

FIG. 1 is a top plan view of the PTCS heating device of the conventional type which has been already referred to;

Before the description of the present invention proceeds, it is to be noted that like elements are designated by like reference numerals throughout the views of the attached drawings.

Figure 1:
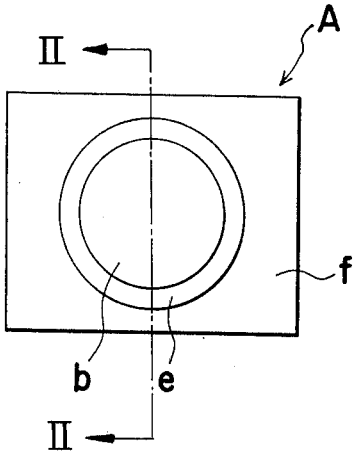
FIG. 1 PRIOR ART
Figure 2:
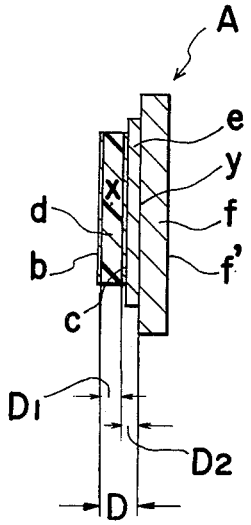
FIG. 2 PRIOR ART
FIG. 2 is a cross sectional view taken along the line II—II in FIG. 1.
Figure 3:
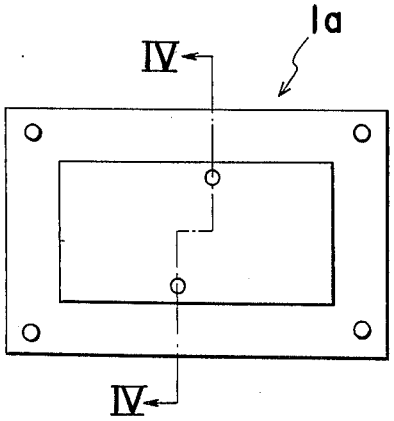
FIG. 3 is a top plan view of the PTCS heating device of the present invention.
Figure 4:
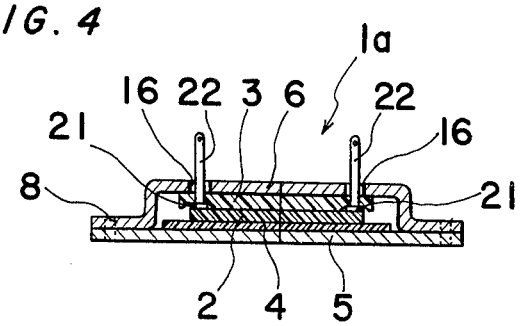
FIG. 4 is a cross sectional view taken along the line IV—IV in FIG. 3.
Figure 5:
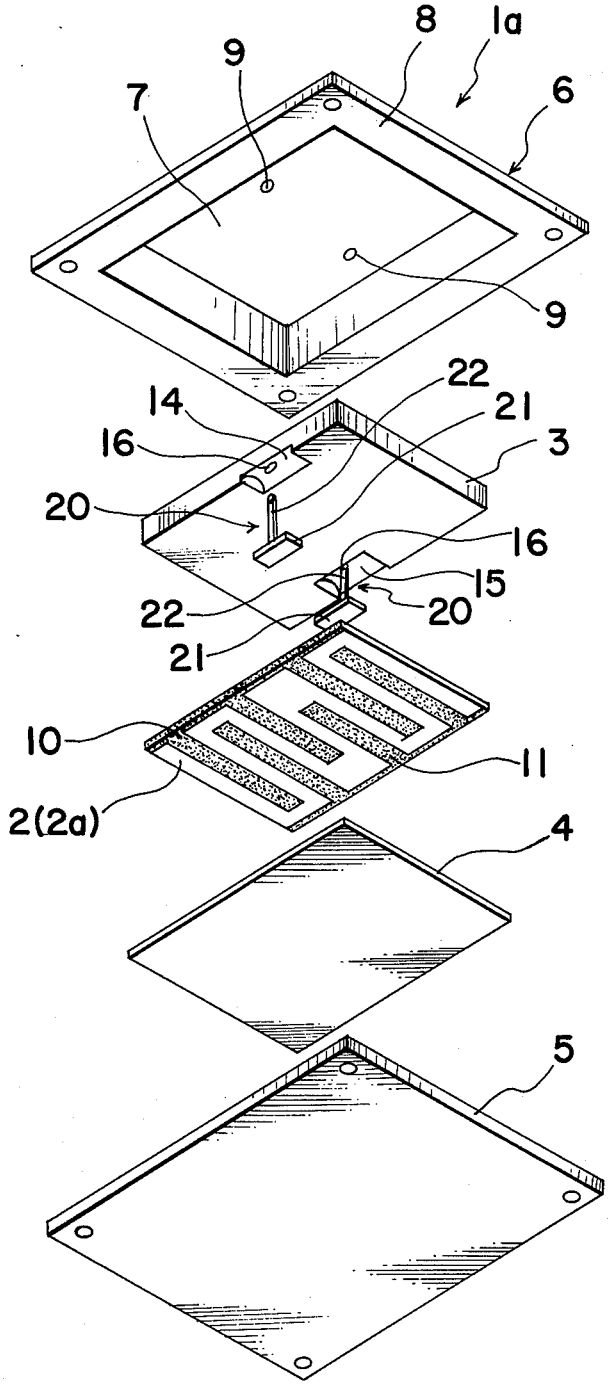
FIG. 5 is an exploded view of the PTCS heating device shown in FIG. 3.

Referring to FIGs. 3, 4 and 5, a positive temperature coefficient semiconductor (PTCS) heating device 1*a* of the present invention comprises a PTCS heating element 2, upper and lower insulating plates 3 and 4 sandwiching the PTCS heating element 2, a heat emission plate 5 for installing thereon said PTCS heating element 2 equipped with the insulating plates 3 and 4 and a case 6 for entirely covering the layers of PTCS heating element 2 and insulating plates 3 and 4. Each of the components constructing the PTCS heating device 1*a* is described in detail hereinbelow.

Figure 6:
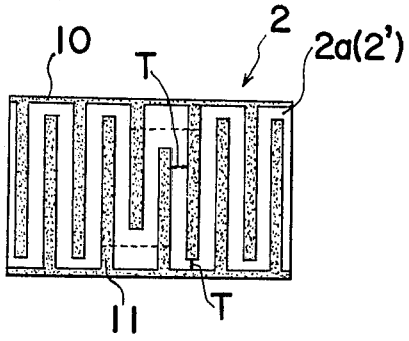
FIGS. 6 and 7 are top and bottom plan views of the PTCS heating element to be employed in the PTCS heating device of FIG. 3.
Figure 7:
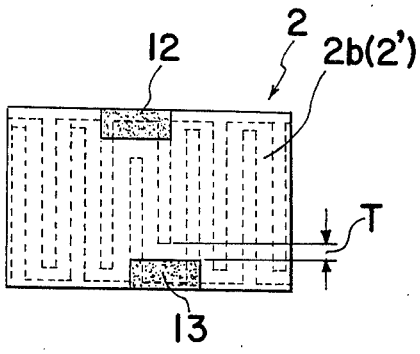

Referring particularly to FIGS. 6 and 7, the PTCS heating element 2 to be employed in this heating device is formed by a rectangular shaped PTCS body 2' with two opposite, flat and mutually parallel faces 2*a* and 2*b*. The face 2*a* which is facing the lower insulating plate 4 is provided with a pair of metal film electrodes 10 and 11. Each electrode has a plurality of strips having a fork-like configuration, in which, each strip is disposed in such a manner that the neighboring strips are separated from each other by a predetermined distance T, while said neighboring strips are members of opposite sets of electrodes and at least one of the strips is shorter than the others. The fact is that every edge of one electrode is apart from the edge of the opposite electrode by the distance T. Provided on the face 2*b* is a pair of terminals 12 and 13 electrically connected to the respective electrodes 10 and 11. When providing the terminals 12 and 13 on the face 2*b*, the terminals 12 and 13 should be located at such positions that each terminal does not overlap, through the PTCS body 2', with any portion of opposite electrode and that the peripheral edge of each terminal is apart from the peripheral edge of opposite electrode by at least the above-described predetermined distance T, so that any electrical current component is not likely to flow between the respective terminals and the opposite electrode through the PTCS body 2' in the thickness direction, thus preventing the electrical current to flow in the thickness direction.

Such PTCS heating element 2 of the above described type is especially suitable for producing heat directly from the flat face 2*a* with an even heat distribution thereof.

Referring back to FIG. 5, the lower insulating plate 4 has a similar configuration to that of the PTCS heating element 2 with its size being equal to or larger than that of the PTCS heating element 2, and is made of electrically insulating and high heat conductive material such as alumina, or porcelain of berylia, or synthetic resin having preferable elasticity, thus isolating the opposite electrodes 10 and 11 from each other and effectively transmitting the heat towards the heat emission plate 5.

The upper insulating plate 3 also has a similar configuration to that of the PTCS heatng element 2 with its size being equal to or larger than that of the PTCS heating element 2, and is made of electrically insulating and high heat conductive material as in lower insulating plate 4, but has a pair of inwardly curved recesses 14 and 15 formed therein at positions corresponding to the two terminals formed on the face 2*b* of the PTCS heating element 2. Each recess is further provided with an aperture 16 at approximately central portion of said recess. Each of these recesses receives a terminal unit 20, comprising a rectangular shaped flat base portion 21 and a pin portion 22 integrally formed with the base portion 21 in perpendicular relation to the latter. When arranging the terminal unit 20 in the PTCS heating device, the base portion 21 must be fixedly placed on the corresponding terminal, while the pin portion 22 must be inserted into the corresponding aperture 16 and penetrating through the upper insulating plate 3. Since the shape of the recess matches with the configuration of the base portion 21, the upper insulating plate 3 can tightly overlap with the PTCS heating element 2. It should be noted that the above-described recesses 14 and 15 are not particularly necessary for insulating plate made of sponge-like material, such as elastic synthetic resin.

Positioned under the lower insulating plate 4 is the heat emission plate 5 made of good heat conductive material such as a metallic plate and having a rectangular shape.

The case 6, positioned above the upper insulating plate 3 is made of a metallic plate, for example, through a process of pressing and has a large rectangular cavity 7 which completely covers the layers of lower insulating plate 4, PTCS heating element 2 and upper insulating plate 3. Formed around the periphery of the cavity 7 is a frame portion 8 which exactly matches with the peripheral portion of the heat emission plate 5, thus completely enveloping the above mentioned layers. A pair of pores 9 are provided at a bottom of the cavity 7 for inserting the pin portion 22 of the terminal unit 20, therethrough.

It should be noted that the surfaces of the upper and lower insulating plates 3 and 4 and heat emission plate 5 are finished by polishing, so called lapping, for exactly matching their faces, so that the heat transmission between the plates may efficiently carried out.

In combining above described components together, said layers and the heat emission plate 5 are tightly secured to each other by a suitable bond, while the base portion 21 of the terminal unit 20 is tightly bonded on the corresponding terminals of the PTCS heating element 2 by an electrically conductive bond or solder. The case 6 is fixedly provided on the heat emission plate 5 by suitable securing screws applied to each corners thereof, or by any other connecting means.

It should be noted that the thickness of said layers is approximately equal to the depth of the cavity 7, so that the case 6 can exactly cover the layer, thus the PTCS heating element 2 employed in the heating device is tightly supported therein.

When a suitable voltage is applied between the pin portions 22 of the terminal units 20, the current flows between the strips of opposite electrodes through the PTCS body 2 predominantly in the region near the face 2*a*, thus generating heat from the face 2*a*. Most of the generated heat is conducted to the heat emission plate 5 through the lower insulating plate 4, and to the object (not shown) to be heated. Some generated heat, however, is conducted to the opposite face 2*b* of the PTCS heating element 2 and to the case 6 through the upper insulating plate 3. If the case 6 is not connected with any object, the heat transmitted to the case 6 is further transmitted to the heat emission plate 5 through the connection between the frame portion 8 and the heat emission plate 5. Thus, the heat produced in the PTCS heating element 2 is efficiently and rapidly conducted to the heat emission plate 5, and thus high rate of heat can be transmitted to the object to be heated. Furthermore, the heat to be emitted or transmitted from the heat emission plate 5 is evenly distributed thereon.

Therefore, when the PTCS heating device of the present invention is applied to an object, for example, to maintain its temperature in predetermined degrees, the rapid heat transmission keeps the temperature of the object within very narrow range of the temperature fluctuation in relation to the predetermined temperature and yet responses very rapidly with the ambient temperature in other words, a temperature change in the ambient temperature influences the PTCS heating element 2 to respond rapidly to change its operating point and to alter the electrical power, thus reliably maintaining the temperature of the object in the predetermined degrees.

Figure 8:
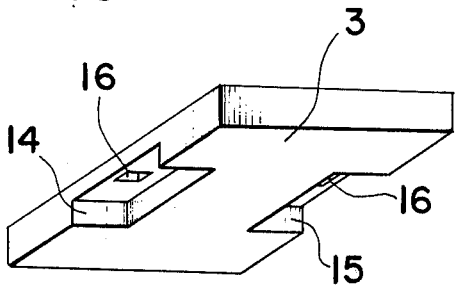
FIG. 8 is a perspective view of the electrical isolating plate.
Figure 9:
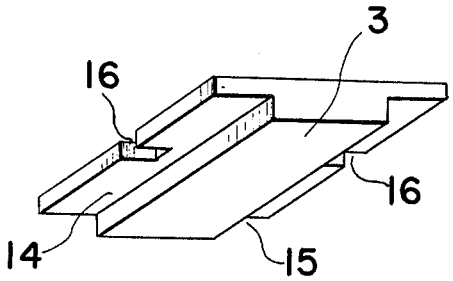
FIG. 9 is a similar view to FIG. 8, but showing a modification thereof.

Referring to FIGS. 8 and 9, showing modifications of the insulating plate 3. Instead of forming the cavities 14 and 15 in inwardly curved shape, such cavities can be formed in any other shape, for example the rectangular recess as clearly seen in FIG. 8 or the elongated recess or step-like recess as shown in FIG. 9. Furthermore, the aperture 16 formed in the recess can be a groove like aperture as shown in FIG. 9.

Figure 10:
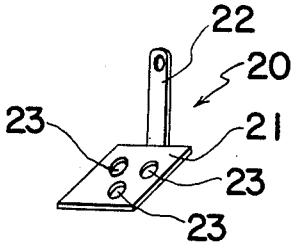
FIG. 10 is a perspective view of the terminal unit.
Figure 11:
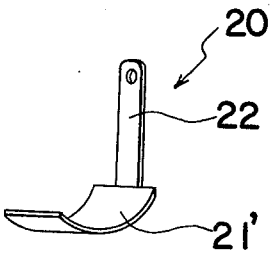
FIG. 11 is a similar view to FIG. 10, but showing a modification thereof.

Referring to FIGS. 10 and 11 showing modifications of the terminal unit 20. The base portion 21 of the terminal unit described as having a flat rectangular shape may be further formed with at least one opening 23 (in this case three openings), as shown in FIG. 10, for allowing excess bond or solder to escape into the openings 23 when fixedly placing the terminal unit 20 onto the corresponding terminals 12 and 13. In another modification shown in FIG. 11, the base portion 21′ may be formed in a curved shape for obtaining preferable spring force, so that the connection between the terminal unit 20 and the corresponding terminals 12 and 13 is ensured when the upper insulating plate 3 is exactly placed on the PTCS heating element 2.

Figure 12:
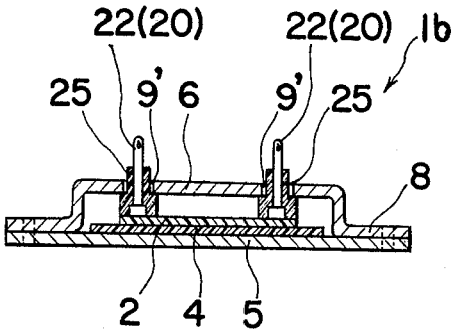
FIG. 12 is a similar view of FIG. 4, but showing a modification thereof.
Figure 13:
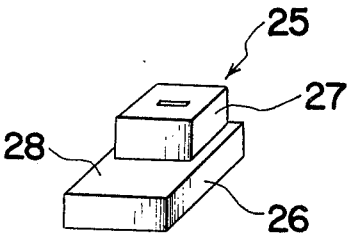
FIG. 13 is a perspective view of a boss to be employed in the PTCS heating device shown in FIG. 12.

Referring now to FIG. 12, there is shown a PTCS heating device 1*b* of the present invention, which is an another embodiment of the above described PTCS heating device 1*a*. In the PTCS heating device 1*b* of this embodiment, the upper insulating plate 3 is replaced by two bushings 25 each made of insulating material such as hard rubber, porcelain or synthetic resin for positioning and securing the terminal unit 20 and also for isolating the PTCS heating element 2 from the case 6. Each bushing 25, as most clearly seen in FIG. 13, comprises a base block 26 having a recess (can not be seen in FIG. 13) at bottom thereof for incorporating the base portion 21 of the terminal unit 20 therein and a projecting portion 27 integrally formed on the base block 26 and having a through-hole formed therein for inserting the pin portion 22 therein. The two bores 9′ formed in the case 6 in this embodiment are large enough for inserting therein the projecting portion 27 of the bushing 25, so that when the case 6 is exactly placed on the heat emission plate 5, the case 6 engages with the shoulder-like portion 28 of the bushing 25 to press down the layers of the PTCS heating element 2 and the lower insulating plate 4 against the heat emission plate 5, as shown in FIG. 12.

Figure 14:
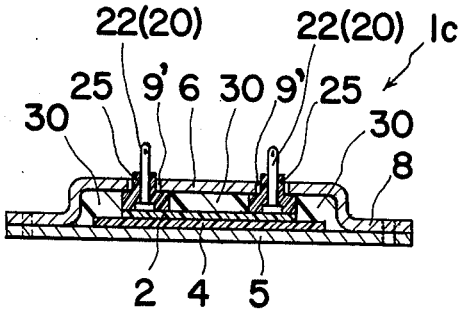
FIG. 14 is a similar view to FIG. 4, but showing another modification thereof.

Referring to FIG. 14, there is shown a PTCS heating device 1*c*, which is still another embodiment of the present invention, and which is further provided with injected material 30 in the cavity formed by the case 6 and the heat emission plate 5, for enforcing and maintaining the layers of PTCS heating element 2 and the lower insulating plate 4 at their position.

Such material 30 can be, for example thermosetting resin, injected into the cavity through a suitable opening (not shown) formed in the case 6.

Figure 15:
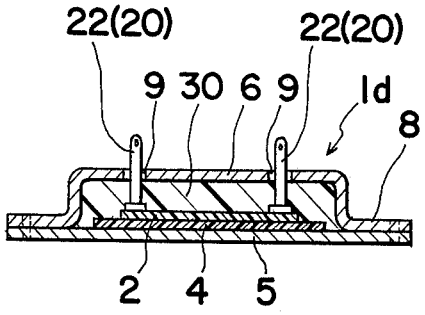
FIG. 15 is a similar view to FIG. 4, but showing a further modification thereof.

Referring to FIG. 15, there is shown a PTCS heating device 1*d*, which is another embodiment of the present invention. In this embodiment, the bushing 25 described as employed for positioning and securing the terminal unit 20 is replaced by the injected material 30. Thus, simplifying the manufacturing steps and reducing the cost thereof.

Figure 16:
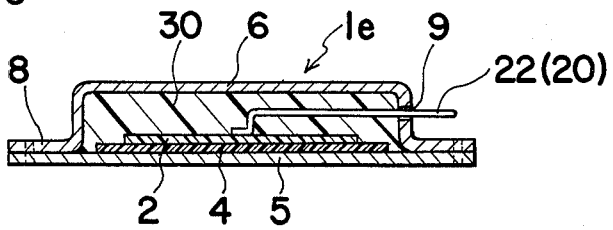
FIG. 16 is a similar view to FIG. 4, but showing still further modification thereof.

Referring to FIG. 16, there is shown a PTCS heating device 1*e*, which is a further embodiment of the present invention. In this embodiment, the pair of terminal units 20 described as extending from the top of the PTCS heating device, are extending outwardly from the PTCS heating device at sides of the case 6, so that the pin portion 22 will not hinder any neighboring object (not shown).

Figure 17:
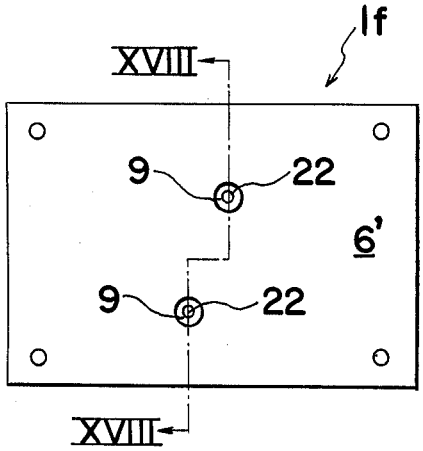
FIG. 17 is a similar view to FIG. 3, but showing a modification thereof.
Figure 18:
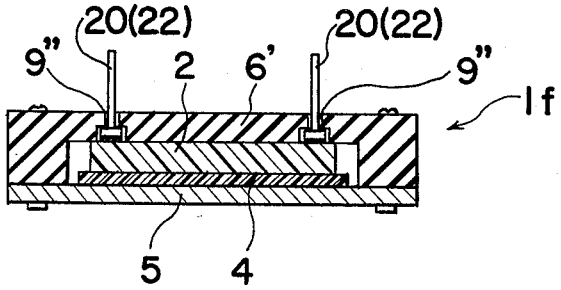
FIG. 18 is a cross sectional view taken along the line XVIII—XVIII in FIG. 17.
Figure 19:
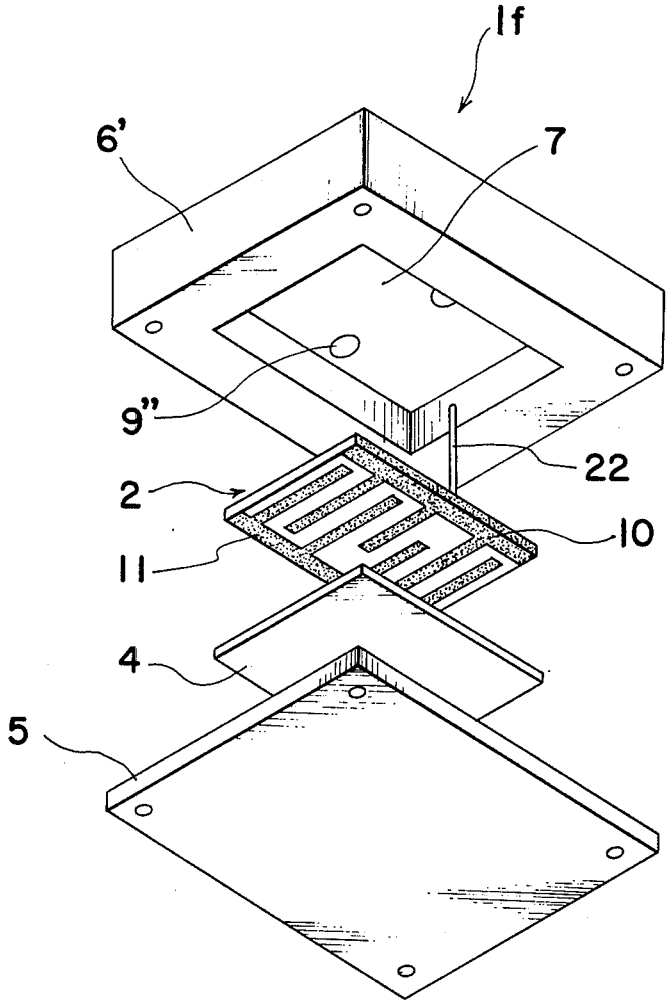
FIG. 19 is an exploded view of the PTCS heating device shown in FIG. 17

Referring to FIGS. 17, 18 and 19, there is shown a PTCS heating device 1*f*, which is a still further embodiment of the present invention. The PTCS heating device 1*f* has a case 6′ made of electrically insulating and good heat conductive material such as porcelain whose ingredient may be alumina, instead of the above described case 6 which is made of metal. The case 6′ in this embodiment is directly placed on the PTCS heating element 2 since they are electrically insulated material, thus fixedly holding the layers of PTCS heating element 2 and the lower insulating plate between the case 6′ and the heat emission plate 5.

The terminal unit 20 connected with the corresponding terminals engages with an edge or step portion formed in the pore 9″ for securing its position while the base portion 21 thereof electrically connects with the terminal through a suitable spring means for ensuring the connection therebetween or otherwise the base portion 21 is fixedly placed on the terminal by means of soldering or electrical conductive bond.

Since the constructing components of the PTCS heating device 1f are fewer than the above described devices, the manufacturing steps are simplified and their cost is reduced.

It should be noted that in the above described various embodiment, the PTCS heating element 2 described as having strips of electrodes on the face 2*a* can be further provided with additional strips on the face 2*b* in the similar manner to those on the face 2*a* for generating heat from both faces 2*a* and 2*b*. Since the strips of the same electrodes are disposed to face each other, no electrical current is likely to flow in the thickness direction of the PTCS body 2′, thus no heat is generated in the inner region, but only in the regions near the opposite faces 2*a* and 2*b* between the opposite electrodes, so that the generated heat is rapidly emitted from the faces 2*a* and 2*b*, while the PTCS body 2′ can be formed in conparatively thin layer.

It should also be noted that the layers of the heat emission plate 5, lower insulating plate 4, PTCS heating element 2, upper insulating plate 3 if any, and the case 6 or 6′ can be further provided with films of high heat conductive material such as silicon rubber or silicon grease.

Since the PTCS heating device of the present invention employs therein the efficient heat producing PTCS heating element 2, and the generated heat therefrom can be transmitted at a high rate to the heat emission plate 5, the object to be heated receives the heat efficiently. Also the layers to be incorporated in the PTCS heating device, i.e., upper insulating plate 3, PTCS heating element 2 and lower insulating plate 4 are supported so tightly by the bushing 25 and/or by the injected material 30 that such layers are not likely to be detached or disengaged by the impact or shock.

Although the present invention has been fully described by way of examples with reference to the accompanying drawings, it is to be noted that various changes and modifications are apparent to those skilled in the art. Therefore, unless such changes and modifications depart from the scope of the present invention, they should be construed as included therein.

What is claimed is:

1. A positive temperature coefficient semiconductor (PTCS) heating device comprising:

a. a PTCS body having two opposed flat and mutually parallel faces;

b. a first electrode means having a plurality of strips of metal film electrically connected to each other at one end thereof and being separated from each other along their respective lengths with at least one of said strips being shorter than the other strips and said first electrode means being provided on one of said two opposed faces of said PTCS body;

c. a second electrode means having a plurality of strips of metal film electrically connected to each other at one end thereof and being separated from each other along their respective lengths with at least one of said strips being shorter than the other strips and said second electrode means being provided on said one of said opposed faces in such a manner that the strips of opposite electrodes are alternately disposed on said one face so that adjacent strips of the respective strips are members of different ones of said first and second electrode means;

d. a first terminal of a pair of terminals for applying a predetermined voltage to said first electrode means and provided on the other of said opposed faces at such a position that said first terminal does not overlap, through the PTCS body, with any of the strips of said second electrode means;

e. a second terminal of said pair of terminals, said second terminal electrically connected to said second electrode means and provided on said other of said opposed faces at such a position that said second terminal does not overlap, through the PTCS body, with any of the strips of said first electrode;

f. a lower insulating means provided on a lower face of said two faces of the PTCS body for electrically insulating said electrodes;

g. an upper insulating means provided on an upper face of said two faces of the PTSC body for electrically insulating said terminals;

h. a metallic heat emission plate provided directly below said lower insulating means for emitting heat therefrom obtained from said PTCS heating element through said lower insulating means;

i. a metallic case means for entirely covering said PTCS heating element and said lower and upper insulating means together with said heat emission plate; and j. a pair of terminal units each having base portions for electrically connecting with corresponding said terminals and a pin portion extending outwardly from said case means through said upper insulating means for connecting to an electrical power supply.

2. A PTCS heating device as claimed in claim 1, wherein said lower insulating means is a plate made of electrically insulating and high heat conductive material.

3. A PTCS heating device as claimed in claim 2, wherein said upper insulating means is a plate made of electrically insulating and high heat conductive material.

4. A PTCS heating device as claimed in claim 2, wherein said upper insulating means is a pair of bushings each provided around a pin portion of said terminal unit and having shoulder-like edge portions for engaging with said case means, thereby maintaining predetermined clearance between the case means and the PTCS heating element.

5. A PTCS heating device as claimed in claim 4, further comprises electrically insulating injected material injected in said clearance through a suitable opening formed in the case means.

6. A PTCS heating device as claimed in claim 2, wherein said upper insulating means is an injected material injected through a suitable opening formed in the case means.

* * * * *